US005829580A

United States Patent [19]

Schroeter

[11] Patent Number: 5,829,580

[45] Date of Patent: Nov. 3, 1998

[54] KEY CASE

[75] Inventor: Timothy T. Schroeter, Greendale, Wis.

[73] Assignee: DCI Marketing, Inc., Milwaukee, Wis.

[21] Appl. No.: 898,272

[22] Filed: Jul. 22, 1997

[51] Int. Cl.[6] ..... A45C 11/32

[52] U.S. Cl. ..... 206/38.1; 206/37.1; 206/232

[58] Field of Search ..... 206/37.1, 37.3, 206/38, 38.1, 37.4, 37.5, 37.6, 232; 70/456 R, 457

[56] References Cited

U.S. PATENT DOCUMENTS

| | | | |
|---|---|---|---|
| Re. 32,914 | 5/1989 | Almblad . | |
| D. 245,371 | 8/1977 | Mowry . | |
| D. 259,073 | 5/1981 | Holmes . | |
| 2,313,485 | 3/1943 | Stiller . | |
| 2,435,032 | 1/1948 | Campbell | 206/38.1 |
| 2,569,629 | 10/1951 | Everitt . | |
| 2,629,251 | 2/1953 | Schwalberg | 206/38.1 |
| 2,635,665 | 4/1953 | Ashley . | |
| 2,734,624 | 2/1956 | Kernicki . | |
| 2,859,789 | 11/1958 | Buckett . | |
| 3,101,762 | 8/1963 | Bermingham . | |
| 3,457,746 | 7/1969 | Glassman . | |
| 3,522,829 | 8/1970 | Weintraub | 206/37.1 |
| 3,606,777 | 9/1971 | Watson . | |
| 3,926,234 | 12/1975 | Dean . | |
| 3,933,017 | 1/1976 | Shee . | |
| 4,037,716 | 7/1977 | Marks . | |
| 4,125,920 | 11/1978 | Grimes . | |
| 4,417,612 | 11/1983 | Couture et al. . | |
| 4,454,737 | 6/1984 | Toyoda . | |
| 4,637,236 | 1/1987 | Almblad . | |
| 4,677,835 | 7/1987 | Almblad . | |
| 4,785,645 | 11/1988 | Dengel . | |
| 4,796,750 | 1/1989 | Inghram . | |
| 4,901,549 | 2/1990 | Dengel | 70/457 |
| 5,511,390 | 4/1996 | Mah | 206/37.1 |

FOREIGN PATENT DOCUMENTS

| | | |
|---|---|---|
| 0240804 | 3/1987 | European Pat. Off. . |
| 1266751 | 6/1961 | France . |
| 10310 | of 1912 | United Kingdom . |
| 342977 | 5/1930 | United Kingdom . |
| 449082 | 12/1934 | United Kingdom . |
| 877325 | 11/1958 | United Kingdom . |
| 845526 | 8/1960 | United Kingdom . |
| 998567 | 4/1964 | United Kingdom . |

*Primary Examiner*—Paul T. Sewell
*Assistant Examiner*—Luan K. Bui
*Attorney, Agent, or Firm*—Michael Best & Friedrich LLP

[57] ABSTRACT

A key container is made up of first and second flaps having a common elongated edge which in turn has opposite ends forming a hinge joint between panels. Each flap has a marginal edge extending from adjacent one end of the hinge joint to the other end of the hinge joint to thereby define the periphery of the flap. One flap has a pocket formed by a portion of its peripheral edge and first and second panels extending from that portion of the periphery of the one flap to a common internal connection spaced inwardly of the peripheral edge. The first and second panels overlie one another and are separated one from the other over their respective extensions from the peripheral edge to the internal connection. A notch in the peripheral edge opens into the pocket. An opening in one of the panels is spaced from the notch and has an extension between said peripheral edge and the internal common connection. A third panel overlies at least a portion of the other flap and has an edge which is joined in part to the other flap and is free in part from that flap to define a pocket.

9 Claims, 1 Drawing Sheet

KEY CASE

FIELD OF THE INVENTION

This invention relates to a container for storing a spare or emergency key in a secure, compact and portable manner.

BACKGROUND OF THE INVENTION

It is common practice to provide extra keys for various products, for example automobiles, to be used in emergencies such as a forgotten or lost key. The need to provide for effective storage, portability and easy access when required has long been recognized. Various designs have been proposed in the past.

SUMMARY OF THE INVENTION

Among the objects of this invention is a container which provides that storage capability, portability and ease of access in an attractive, ergonomically designed, cost effective package.

For the achievement of those and other objects this invention proposes a key container constructed with first and second flaps having a common elongated edge forming a joint between the flaps and which in turn has opposite ends. Each flap has a marginal edge extending from adjacent one end of the joint to the other end of the joint thereby defining the periphery of the flaps. One of the flaps is made up of first and second panels and has a pocket formed by the cooperation of a portion of the peripheral edge of a flap and portions of the first and second panels which extend from that portion of the periphery of panel to a common joint between the panels. That common joint extends inwardly from the peripheral edge of the flap with the first and second flaps overlaying one another but separated one from the other over their respective extensions from the peripheral edge to the common joint. A notch is formed in the peripheral edge at the pocket defining an opening into that area between the first and second flaps and through which the tip or the extension of a key can protrude. One of the panels includes an opening spaced from the notch and having an extension between the peripheral edge and the common joint through which a key can be inserted into the pocket formed between the two panels. The dimension across the notch is less than the length of opening into the pocket so that a key can only be inserted and withdrawn through the opening into the pocket and not through the notch.

A third panel can be provided to overlie at least a portion of the other flap. The third panel has an edge which is joined in part to that flap and is free in part from that flap thereby defining another storage pocket between that flap and the third panel.

Other objects and advantages of this invention will be pointed out in or be apparent from, the specification and claims, as will obvious modifications of the embodiment shown in the drawings in which:

DETAILED DESCRIPTION OF THE PREFERRED EMBODIMENT

Figure 1:
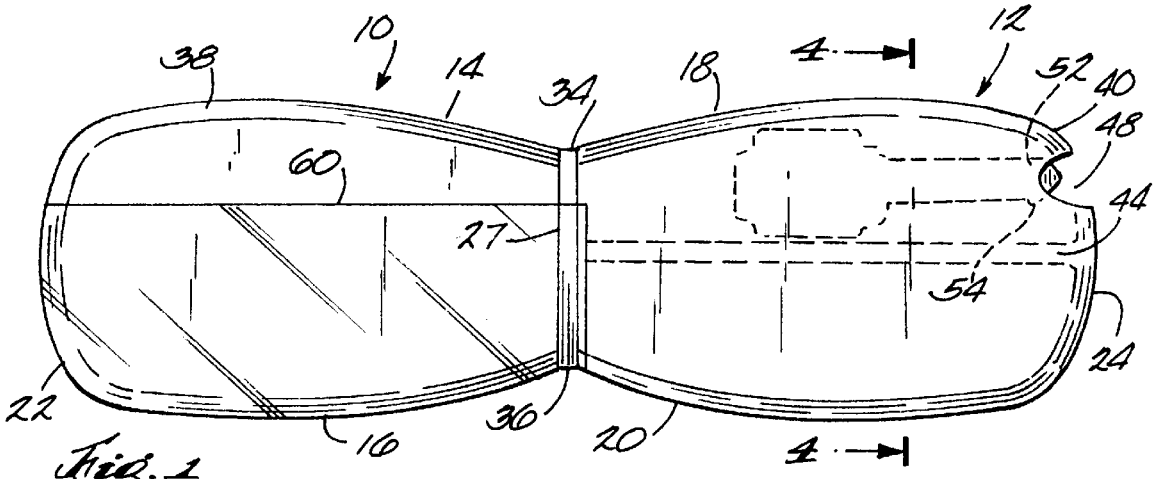
FIG. 1 is a plan view of the container.
Figure 2:
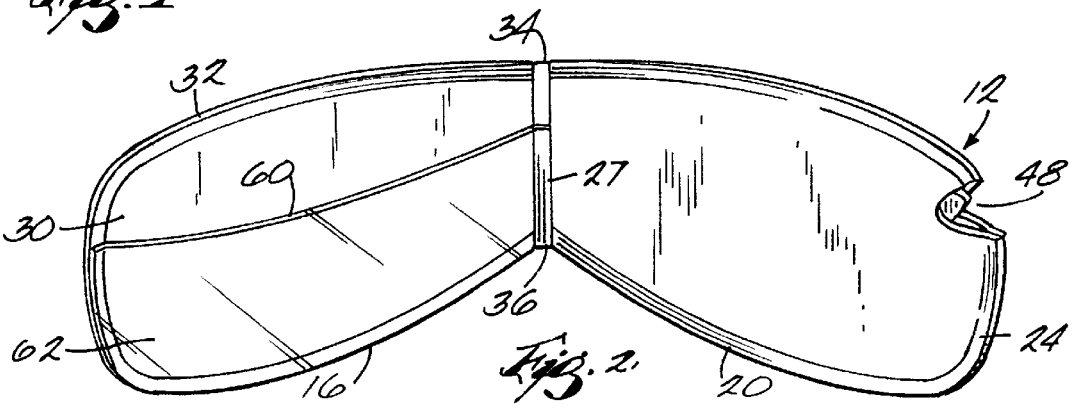
FIG. 2 is a perspective illustrating the container partially folded.
Figure 3:
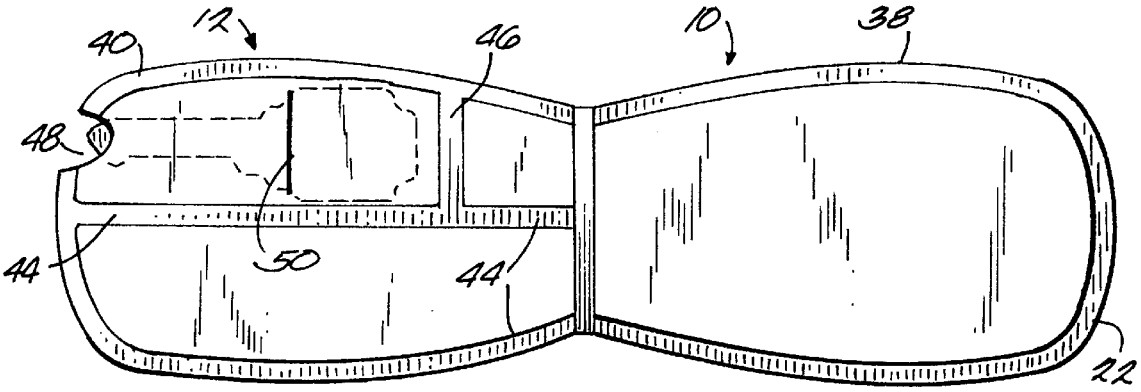
FIG. 3 is a plan view of the side of the container opposite to that illustration in FIG. 1.
Figure 4:
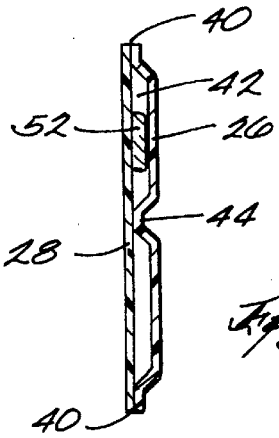
FIG. 4 is a section taken along lines 4—4 in FIG. 1.

With reference to the drawings, the illustrated preferred embodiment includes two substantially identical flaps 10 and 12. The flaps are generally rectangular in overall configuration but have slightly arcuate or rounded side portions 14, 16, 18 and 20 and arcuate or rounded end portions 22 and 24 with rounded corners forming the transition from the side portions to the end portions. In its unfolded position, the container is elongated along a longitudinal axis extending from end 22 to end 24. This configuration is not only aesthetically pleasing but also results in a container which can be readily inserted into, for example, a wallet or compartments in a woman's purse, either in a flat or folded position.

The body portions 10 and 14 have a common edge forming a joint 26 between those two portions. The body portions 10 and 12 can then be pivoted relative to each other about that joint so that the overall container can be folded into a more compact configuration with the body portions laying one on top the other. It will be noted that flaps 10 and 12 are of the same size so that their respective peripheral edges lie one atop the other when folded.

In the preferred embodiment, the flaps 10 and 12 are each made up of two panels 26, and 28 in flap 12 and 30 and 32 in flap 10. Actually, as will be described more completely hereinafter, the container is made from two initially identically shaped panels processed to provide the appearance of two flaps connected by joint 27.

The flaps/panels are made from a conventional vinyl material.

The overlapping marginal edges of panels 26 and 28 are joined together by a conventional heat sealing operation. Similarly, the marginal edges of the panels forming flap 10 are joined together by the same type of process. This provides an external connection extending from one end 34 of joint 27 to the opposite end 36 of that joint to define the peripheral edge of flap 10. Similarly, the heat seal joint extends, around flap 12 from end 34 of joint 27 to end 36 of joint 27 to define an external connection and the peripheral edge 40 of flap 12.

A pocket 42 is formed in the flap 12. This pocket is formed by joining panels 26 and 28 along an internal connection line 44 and along a second internal connection line 46. Both internal connections 44 and 46 extend inwardly from the periphery of flap 12 until they intersect. The connections 44 and 46 are, in the preferred embodiment, oriented at right angles. This forms the pocket 42 between joints 44 and 46 and peripheral edge 40.

A notch 48 is cut through the peripheral edge of flap 12 and into pocket 42. In addition, an opening 50 is made in panel 28 between the peripheral edge of that panel and joint 44. The opening 50 is preferably a slit so that the opposed faces of the opening are in close proximity thereby forming a tight opening into the pocket.

The joint 46 is positioned nearer joint 27 than end 24 of flap 12 and is between the opening 50 and the joint 34.

With that pocket configuration, a key 52 can be inserted into the pocket through the slit with the extension of the key pointing toward notch 48. The enlarged head of the key fits through the slit and then is moved back adjacent joint 46, that joint thereby maintaining the position of the key in the pocket placing the key end 54 in relative proximity to notch 48 so that the end 54 and the extension 52 can be moved through the notch to expose the key for use by simple manipulation of the flap, i.e., bending the flap to squeeze the key forward through the notch. Since opening 50 is a tight slit opening, it will not interfere with movement of the key either in its extension through the notch or its retraction back into the pocket with the head adjacent joint 46.

A second pocket is provided on flap 10. This is formed by a segment 62 of conventional clear vinyl material which has an edge 60 which is free from the surface of flap 10 but the remainder of the edge of segment 62 is joined to the peripheral edge 16 of the flap and the common joint 27 in the same manner as the joint forming the peripheral edges of that flap. This provides a pocket for insertion of printed material and the like which may carry personal or automobile information.

It should also be noted that the various exposed surfaces of the flaps 10 and 12 provide ample room for printing of copy material relating to the particular key application which is being stored.

In the construction of this container, two identically shaped panels of vinyl are superimposed one on the other. These superimposed panels are then put through the heat sealing process forming the external connections along the peripheral edges, the common joint 27, and the internal connection 44 and 46. The member 60 can also be heat sealed to the panel all in one operation or separately.

The cuts in the panels 26 and 28 can be made either before that joining operation or after. The opening 50 in panel 28 is preferably made before joining the two panels.

Although but one embodiment of the present invention has been illustrated and described, it will be apparent to those skilled in the art that various changes and modifications may be made therein without departing from the spirit of the invention or from the scope of the appended claims.

I claim:

1. A container comprising, in combination, first and second flaps having a common elongated hinge edge which in turn has opposite ends, each flap has an external marginal edge extending from adjacent one end of said elongated hinge edge to the other end of said elongated hinge edge to define the periphery of said flaps, one flap has a pocket formed by a portion of the peripheral edge of said one flap and first and second panels extending from said portion of said periphery of said one flap to a common internal connection extending inwardly of said peripheral edge and said elongated hinge edge, said first and second panels overlaying one another and separated one from the other over their respective extensions from said peripheral edge to said common internal connection, a notch in said peripheral edge defining an opening into the area between said first and second panels, a second opening in one of said panels spaced from said notch and having an extension between said peripheral edge and said internal common connection, and a third panel overlying at least a portion of the other flap and having an edge which is joined in part to said other flap and free in part from said other flap to define a pocket second between said other flap and said third panel.

2. The container of claim 1 wherein said flaps are made of first and second overlying panel portions joined along their peripheries to define a common peripheral edge.

3. The container of claim 2 wherein said internal common connection is a connection between said overlying panels.

4. The container of claim 3 wherein said internal common connection includes a first extension extending inwardly from a first portion of said peripheral edge and a second extension extending laterally from said first extension to another portion of said periphery different from said first portion.

5. The container of claim 1 wherein said first and second flaps have a generally common longitudinal axis, said common hinge edge of said flaps extend generally normal to said longitudinal axis along a line extending between said peripheral edges of said flaps, said first internal connection extends generally parallel to said longitudinal axis and said second internal connection extends generally normal to said first joint extension.

6. The container of claim 5 wherein the dimension across said notch is less than the length of said opening into said pocket.

7. The container of claim 6 wherein the opening in one of said panels is a slit in said one of said panels extending generally perpendicular to said first internal connection extension and in spaced relationship from and generally parallel to said second internal connection extension.

8. The container of claim 7 wherein said common hinge edge of said first and second flaps forms a hinge about which said can be folded to overlap one another.

9. A container comprising, in combination, first and second flaps having a common elongated hinge edge which in turn has opposite ends, each flap has an external marginal edge extending from adjacent one end of said elongated hinge edge to the other end of said elongated hinge edge to define the periphery of said flaps, one flap has a pocket formed by a portion of the peripheral edge of said one flap and first and second panels extending from said portion of said periphery of said one flap to a common internal connection extending inwardly of said peripheral edge and said elongated hinge edge, said first and second panels overlaying one another and separated one from the other over their respective extensions from said peripheral edge to said common internal connection, a notch in said peripheral edge defining an opening into the area between said first and second panels, a second opening in one of said panels spaced from said notch and having an extension between said peripheral edge and said internal common connection.

* * * * *